United States Patent [19]

Tammi

[11] Patent Number: 5,011,045

[45] Date of Patent: Apr. 30, 1991

[54] PAINT TONER DISPENSING MACHINE

[75] Inventor: Anssi Tammi, Vanha Ulvila, Finland

[73] Assignee: Cimcorp Oy, Ulvila, Finland

[21] Appl. No.: 401,436

[22] PCT Filed: Mar. 17, 1988

[86] PCT No.: PCT/FI88/00039

§ 371 Date: Sep. 14, 1989

§ 102(e) Date: Sep. 14, 1989

[87] PCT Pub. No.: WO88/06980

PCT Pub. Date: Sep. 22, 1988

[30] Foreign Application Priority Data

Mar. 20, 1987 [FI] Finland ..... 871239

[51] Int. Cl.[5] ..... B65D 88/54

[52] U.S. Cl. ..... 222/318; 222/380; 222/385; 222/504; 222/510

[58] Field of Search ..... 222/377, 380, 504, 318, 222/510, 383, 385; 417/310, 440; 137/569, 872, 862

[56] References Cited

U.S. PATENT DOCUMENTS

| | | | |
|---|---|---|---|
| 1,992,736 | 2/1935 | Bronander et al. | 222/318 |
| 2,545,588 | 3/1951 | Pulse | 222/318 X |
| 2,566,702 | 9/1951 | Harrigan | 222/318 X |
| 2,652,175 | 9/1953 | Davis | 222/510 X |
| 2,660,336 | 11/1953 | Coffey et al. | 137/569 X |
| 3,042,259 | 7/1962 | Engel | 222/318 X |
| 3,168,225 | 2/1965 | Miller et al. | 222/380 |
| 3,459,340 | 8/1969 | Smith | 222/380 |
| 3,807,607 | 4/1974 | Kuckens | 222/510 X |
| 4,363,426 | 12/1982 | Heinzl | 222/380 X |
| 4,708,269 | 11/1987 | Willerding | 222/377 |

FOREIGN PATENT DOCUMENTS

| | | |
|---|---|---|
| 162212 | 11/1952 | Australia . |
| 3446828 | 7/1985 | Fed. Rep. of Germany . |
| 304941 | 9/1967 | Sweden . |
| 362387 | 10/1969 | Sweden . |
| 453811 | 3/1988 | Sweden . |

*Primary Examiner*—Andres Kashnikow
*Assistant Examiner*—Gregory L. Huson
*Attorney, Agent, or Firm*—Fitch, Even, Tabin & Flannery

[57] ABSTRACT

A paint toning machine comprising a plurality of color paste containers (1), and a pump (2) for each color paste container (1) for pumping color paste from the container for the dispensing or circulation thereof. For the elimination of the problems caused by leaks occurring in the color paste dispensing pump and the connections of the color paste suction and feeding conduits thereof, the pump (2) according to the invention is arranged in the paste container (1) in the vicinity of a bottom (4) thereof essentially below the surface of the color paste (3) contained in the container.

1 Claim, 1 Drawing Sheet

PAINT TONER DISPENSING MACHINE

This invention relates to a paint toning machine for dispensing solvent-diluted colour pastes in particular, comprising a plurality of paste containers provided with a cover preventing the evaporation of the solvent of the colour paste, and a plurality of colour paste pumps for pumping paste for the dispensing or circulation thereof, each colour paste container comprising one pump.

A paint toning machine of the above type is known e.g. from Australian Patent Specification 162 212. In the paint toning machine of this publication, the dispensing and circulating pump for the colour paste is a gear-type pump positioned outside the colour paste container and connected both to the colour paste container and to a dispensing nozzle by means of hose connections. However, there always exists a risk of leaks in this kind of arrangement, because the hose connections both on the suction and delivery side of the pump are positioned in an open space. In addition, the pump itself has to be encased tightly. This is especially important when solvent-diluted colour pastes are used, as the solvents very easily penetrate through the seals, which causes the colour paste to be hardened and the pipe connections to be clogged. Further, when coming into contact with the seals solvents tend to make the seals inelastic, which can lead to leaks and even to jamming of the drive shaft of the pump. The biggest problem with leaks, however, is the risk of explosion because the used solvents are very inflammable.

The object of the present invention is to provide a paint toning machine in which the above problems are essentially eliminated. This is achieved by means of a paint toning machine according to the invention, which is characterized in that each pump is arranged in its paste container in the vicinity of a bottom thereof essentially below the surface of the colour paste contained in the container and comprises a drive shaft which is led through the cover of the container through a hole. As the pump is so immersed in the colour paste, neither the pump itself nor the connections of the suction and pressure conduits of the pump need be absolutely gastight. Since it is possible to construct the paste container into an essentially closed space wherefrom the drive shaft of the pump and possibly also a dispensing hose project through holes, possible leaks in the pump or the pipe connections thereof cannot have the above-mentioned adverse effects.

Figure 2:
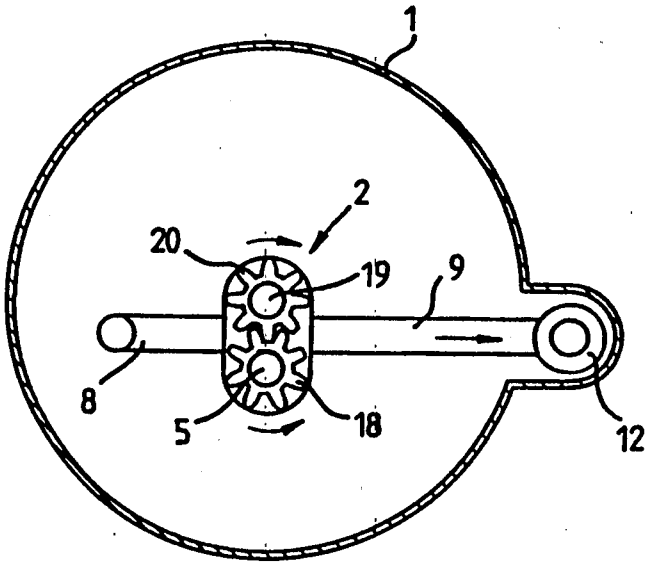
Figure 1:
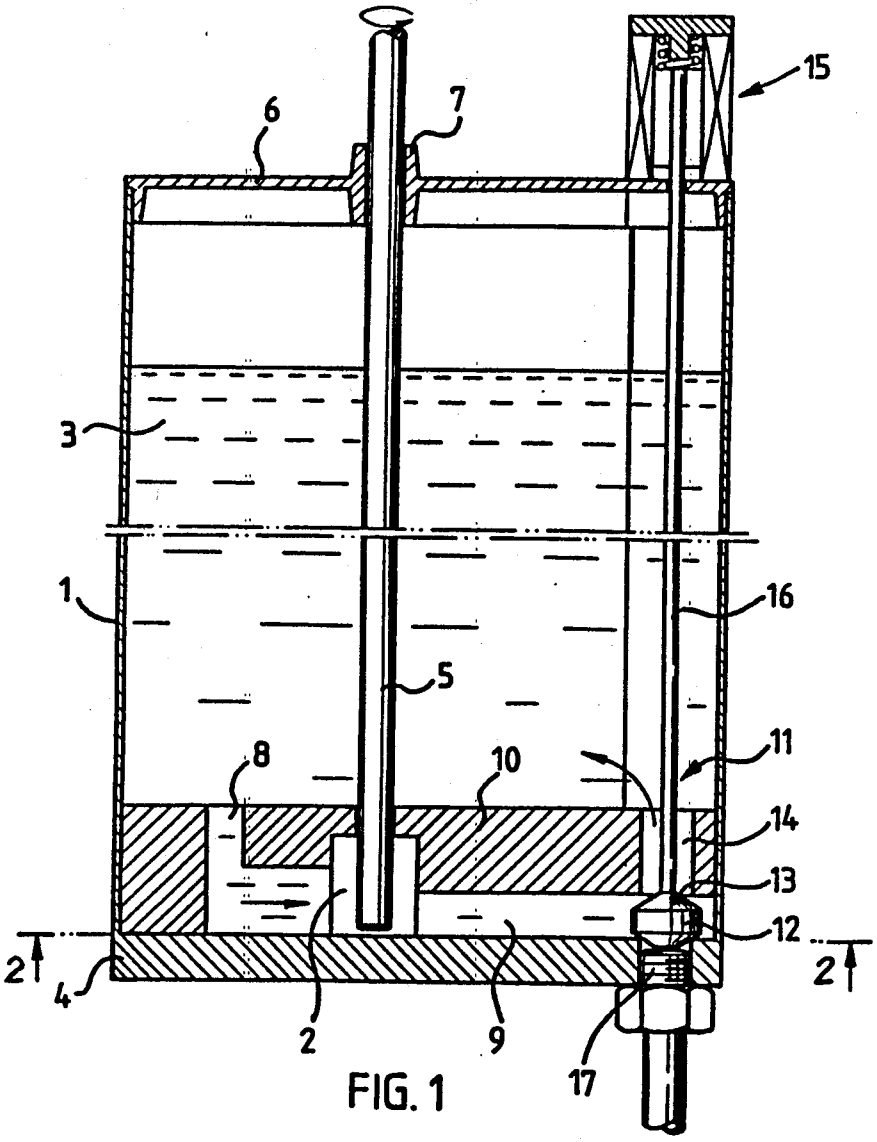

In the following the paint toning machine according to the invention will be described in more detail with reference to the attached drawings, wherein FIG. 1 is a cross-sectional side view of one paste container of the paint toning machine according to the invention, and FIG. 2 is a cross-sectional view of the paste container of FIG. 1 along the line 2—2 in FIG. 1.

FIG. 1 shows one of a plurality of paste containers comprised in the paint toning machine according to the invention; this container is indicated with the reference numeral 1. A gear-type pump 2 is immersed in the colour paste contained in the paste container, and a drive shaft 5 of the pump is led through a cover 6 of the container through a hole 7. The cover 6 of the container is arranged on the container 1 as tightly as possible to prevent evaporation of solvent of the colour paste. In the embodiment of the invention shown in FIG. 1, the pump as such is not encased separately in such a manner that it would comprise pipe connections for suction and pressure conduits; instead, suction and pressure conduits 8 and 9 are formed by means of a floor 10 positioned above a container bottom 4. The floor 10 also forms a structural part of a dispensing valve 11 attached to the colour paste container 1 in such a manner that it forms a seat for an upper conical surface 13 of a spindle 12 of the dispensing valve 11. When the valve 11 is in the position shown in FIG. 1 and the pump 2 is on, the paste 3 flows as shown by the dark arrows in the figure in such a manner that it is sucked through the suction conduit 8 into the pump 2, and it leaves the pump through the pressure conduit 9 and a return conduit 14 going through the floor 10, and returns to the paste container. In this way, the colour paste can be circulated and mixed in the container. When the spindle 12 of the valve 11 is lifted to its upper position by means of a valve operating means 15 positioned on the cover 6 and a valve drive shaft 16, a dispensing outlet of the pressure conduit is opened through the bottom 4 of the container 1 via a conduit 17 to a colour paste dispensing nozzle (not shown).

FIG. 2 shows a section of the colour paste container of FIG. 1 along the line 2—2 shown in FIG. 1. It appears from FIG. 2 that the pump 2 is a gear-type pump comprising a primary gearwheel 18 attached to the drive shaft 5 and a secondary gearwheel attached to a support shaft 19. As is to be seen in FIG. 2, the colour paste container 1 is essentially round in shape with the exception of the projection formed for the dispensing valve.

The paint toning machine according to the invention and especially the dispensing pump immersed in the colour paste contained in the paste container have been described above only by way of example by means of one specific embodiment. It is to be understood that the idea according to the invention of immersing the dispensing pump in the colour paste could be realized also by a conventional dispensing pump. As this pump and the pipe connections thereof would also be wholly immersed in the colour paste, the same advantages as described above can be achieved in this case, too, concerning leaks in the pump itself or the connections thereof.

I claim:

1. A paint toner dispensing machine for dispensing solvent-diluted color pastes in particular, comprising at least one paste container having a bottom and a side wall and provided with a cover preventing the evaporation of the solvent of the color paste;

a gear-type color paste pump for pumping paste for the selective dispensing or circulation thereof and comprising a drive shaft which is led through the cover of the container;

a dispensing valve located within the container for the dispensing of the color paste; and a floor positioned above said bottom;

said pump being arranged completely within the paste container between the bottom thereof and said floor essentially below the surface of the color paste when the color paste is contained in the container, said floor forming together with said bottom therebetween a suction conduit, pressure conduit, return conduit and dispensing conduit for the pump, all within the container; and said pressure conduit being by means of said dispensing valve selectively connectable within the container either to the return conduit or the dispensing conduit.

* * * * *